US006963321B2

(12) United States Patent
Everitt

(10) Patent No.: US 6,963,321 B2
(45) **Date of Patent: *Nov. 8, 2005**

(54) METHOD OF PROVIDING PULSE AMPLITUDE MODULATION FOR OLED DISPLAY DRIVERS

(75) Inventor: James W. Everitt, Granite Bay, CA (US)

(73) Assignee: Clare Micronix Integrated Systems, Inc., Aliso Viejo, CA (US)

( * ) Notice: Subject to any disclaimer, the term of this patent is extended or adjusted under 35 U.S.C. 154(b) by 126 days.

This patent is subject to a terminal disclaimer.

(21) Appl. No.: 10/029,563

(22) Filed: Dec. 20, 2001

(65) Prior Publication Data

US 2002/0167474 A1 Nov. 14, 2002

Related U.S. Application Data

(60) Provisional application No. 60/348,168, filed on Oct. 19, 2001, and provisional application No. 60/290,100, filed on May 9, 2001.

(51) Int. Cl.[7] ..... G09G 3/32

(52) U.S. Cl. ..... 345/82; 345/204; 345/76; 315/169.3

(58) Field of Search ..... 345/55, 76–83, 345/204, 60–64, 72, 84–86, 207; 315/169.1–169.2, 169.3

(56) References Cited

U.S. PATENT DOCUMENTS

| | | | | |
|---|---|---|---|---|
| 4,823,027 A | | 4/1989 | Takahashi | |
| 5,703,608 A | | 12/1997 | Kuga | |
| 5,708,452 A | * | 1/1998 | Takahashi | 345/82 |
| 5,719,589 A | | 2/1998 | Norman et al. | |
| 6,229,508 B1 | | 5/2001 | Kane | |
| 6,369,516 B1 | * | 4/2002 | Iketsu et al. | 315/169.3 |
| 6,369,786 B1 | * | 4/2002 | Suzuki | 345/77 |
| 6,373,478 B1 | * | 4/2002 | Steffensmeier | 345/204 |
| 6,414,661 B1 | | 7/2002 | Shen et al. | |
| 6,473,065 B1 | * | 10/2002 | Fan | 345/82 |
| 6,476,779 B1 | | 11/2002 | Yano et al. | |
| 6,501,230 B1 | | 12/2002 | Feldman | |
| 6,545,652 B1 | | 4/2003 | Tsuji | |
| 2001/0024186 A1 | | 9/2001 | Kane et al. | |

FOREIGN PATENT DOCUMENTS

| | | |
|---|---|---|
| DE | 100 09 204 A1 | 8/2001 |
| EP | 0 905 673 A1 | 3/1999 |
| EP | 1 225 557 A1 | 7/2002 |
| WO | WO 01/26085 A1 | 4/2001 |
| WO | WO 01/27910 A1 | 4/2001 |
| WO | WO 01/63587 A2 | 8/2001 |

OTHER PUBLICATIONS

International Search Report dated Jul. 7, 2003, for International Application No. PCT/US02/33518, filed Oct. 17, 2002.

Office Action dated Jul. 12, 2004 from U.S. Appl. No. 10/029,605 and claims from the respective appln.

Office Action dated Dec. 19, 2003 from U.S. Appln. No. 10/029,605 and claims from the respective appln.

* cited by examiner

*Primary Examiner*—Lun-yi Lao
(74) *Attorney, Agent, or Firm*—Knobbe, Martens, Olson & Bear, LLP

(57) ABSTRACT

A pulse width modulation driver for an organic light emitting diode display. One embodiment of a video display comprises a voltage driver for providing a selected voltage to drive an organic light emitting diode in a video display. The voltage driver may receive voltage information from a correction table that accounts for aging, column resistance, row resistance, and other diode characteristics.

8 Claims, 9 Drawing Sheets

METHOD OF PROVIDING PULSE AMPLITUDE MODULATION FOR OLED DISPLAY DRIVERS

RELATED APPLICATIONS

This application claims the benefit of, and incorporates by reference, in their entirety, each of the following applications: U.S. Provisional Application No. 60/290,100, filed May 9, 2001, entitled "SYSTEM AND METHOD FOR CURRENT BALANCING IN VISUAL DISPLAY DEVICES"and U.S. Provisional Application No. 60/348,168, filed Oct. 19, 2001, entitled "PULSE AMPLITUDE MODULATION SCHEME FOR OLED DISPLAY DRIVER".

This application is related to and incorporates by reference, in its entirety, U.S. application Ser. No.10/029,605, filed Dec. 20, 2001, entitled "SYSTEM FOR PROVIDING PULSE AMPLITUDE MODULATION FOR OLED DISPLAY DRIVERS".

BACKGROUND OF THE INVENTION

1. Field of the Invention

This field of the invention generally relates to organic light emitting devices. More particularly, the invention is directed to a system and method for driving for a matrix of organic light emitting devices in a passive-matrix display.

2. Description of the Related Technology

There is a great deal of interest in "flat panel" displays, particularly for small to midsized displays, such as may be used in laptop computers, cell phones, and personal digital assistants. Liquid crystal displays (LCDs) are a well-known example of such flat panel video displays, and employ a matrix of "pixels" which selectably block or transmit light. LCDs do not provide their own light; rather, the light is provided from an independent source. Luminescent displays are an alternative to LCD displays. Luminescent displays produce their own light, and hence do not require an independent light source. They typically include a matrix of elements which luminesce when excited by current flow. A common luminescent device for such displays is a light emitting diode (LED).

LED arrays produce their own light in response to current flowing through the individual elements of the array. A variety of different LED-like luminescent sources have been used for such displays. The embodiments described herein utilize organic electroluminescent materials in OLEDs (organic light emitting diodes), which include polymer OLEDs (PLEDs) and small-molecule OLEDs, each of which is distinguished by the molecular structure of their color and light producing material as well as by their manufacturing processes. Electrically, these devices look like diodes with forward "on" voltage drops ranging from 2 volts (V) to 20 V depending on the type of OLED material used, the OLED aging, the magnitude of current flowing through the device, temperature, and other parameters. Unlike LCDs, known OLEDs are current driven devices; however, they may be similarly arranged in a 2 dimensional array (matrix) of elements to form a display.

OLED displays can be either passive-matrix or active-matrix. Active-matrix OLED displays use current control circuits integrated with the display itself, with one control circuit corresponding to each individual element on the substrate, to create high-resolution color graphics with a high refresh rate. Passive-matrix OLED displays are easier to build than active-matrix displays, because their current control circuitry is implemented external to the display. This allows the display manufacturing process to be significantly simplified.

FIG. 1A is an exploded view of a typical physical structure of such a passive-matrix display 100 of OLEDs. A layer 110 having a representative series of rows, such as parallel conductors 111–118, is disposed on one side of a sheet of light emitting polymer, or other emissive material 120. A representative series of columns are shown as parallel transparent conductors 131–138, which are disposed on the other side of sheet 120, adjacent to a glass plate 140. FIG. 1B is a cross-section of the display 100, and shows a drive voltage V applied between a row 111 and a column 134. A portion of the sheet 120 disposed between the row 111 and the column 134 forms an element 150 which behaves like an LED. The potential developed across this LED causes current flow, so the LED emits light 170. Since the emitted light 170 must pass through the column conductor 134, such column conductors are transparent. Most such transparent conductors have relatively high resistance compared with the row conductors 111–118, which may be formed from opaque materials, such as copper, having a low resistivity.

This structure results in a matrix of devices, one device formed at each point where a row overlies a column. There will generally be M×N devices in a matrix having M rows and N columns. Typical devices function like light emitting diodes (LEDs), which conduct current and luminesce when voltage of one polarity is imposed across them, and block current when voltage of the opposite polarity is applied. Exactly one device is common to both a particular row and a particular column, so to control these individual LED devices located at the matrix junctions it is useful to have two distinct driver circuits, one to drive the columns and one to drive the rows. It is conventional to sequentially scan the rows (conventionally connected to device cathodes) with a driver switch to a known voltage such as ground, and to provide another driver to drive the columns (which are conventionally connected to device anodes).

FIG. 2 represents such a conventional arrangement for driving a display having M rows and N columns. A column driver device 260 includes one column drive circuit (e.g. 262, 264, 266) for each column. The column driver circuit 264 shows some of the details which are typically provided in each column driver, including a current source 270 and a switch 272 which enables a column connection 274 to be connected to either the current source 270 to illuminate the selected diode, or to ground to turn off the selected diode. A scan circuit 250 includes representations of row driver switches (208, 218, 228, 238 and 248). A luminescent display 280 represents a display having M rows and N columns, though only five representative rows and three representative columns are drawn.

The rows of FIG. 2 are typically a series of parallel connection lines traversing the back of a polymer, organic or other luminescent sheet, and the columns are a second series of connection lines perpendicular to the rows and traversing the front of such sheet, as shown in FIG. 1A. Luminescent elements are established at each region where a row and a column overlie each other so as to form connections on either side of the element. FIG. 2 represents each element as including both an LED aspect (indicated by a diode schematic symbol) and a parasitic capacitor aspect (indicated by a capacitor symbol labeled "CP").

In operation, information is transferred to the matrix display by scanning each row in sequence. During each row scan period, each column connected to an element intended to emit light is also driven. For example, in FIG. 2 a row switch 228 grounds the row to which the cathodes of elements 222, 224 and 226 are connected during a scan of Row K. The column driver switch 272 connects the column connection 274 to the current source 270, such that the element 224 is provided with current. Each of the other columns 1 to N may also be providing current to the respective elements connected to Row K at this time, such as the element 222 or 226. All current sources are typically at the same amplitude. OLED element light output is controlled by controlling the amount of time the current source for the particular column is on. When an OLED element has completed outputting light, its anode is pulled to ground to turn off the element. At the end of the scan period for Row K, the row switch 228 will typically disconnect Row K from ground and apply Vdd instead. Then, the scan of the next row will begin, with row switch 238 connecting the row to ground, and the appropriate column drivers supplying current to the desired elements, e.g. 232, 234 and/or 236.

This process is typically modified to account for display parasitic capacitance. The light output of an OLED pixel is approximately proportional to the current flowing through it. Therefore, to control the light output the OLED pixel gives off, the magnitude and duration of the current flowing through it must be controlled. However, a given column in the display has a significant parasitic capacitance due to the parasitic capacitance of the "off" OLEDs in the column. The output current from the column driver must charge this capacitance in order for the column voltage to rise high enough to turn on the selected OLED. The charge that flows into the parasitic capacitance is subtracted from the charge intended for the on OLED, thus reducing its charge. This loss is significant for displays of practical size and practical scan rates. Some form of precharge scheme is typically used to bring the OLED rapidly up to its desired on voltage at the beginning of the row write cycle. There can be some variations to the process just described.

The above approach of driving all pixels with the same current magnitude and controlling pixel brightness by controlling the duration of time the pixel is on works well at slow scan rates. However, as the display scan rate is raised to a level that is required to prevent perceivable flicker a number of problems arise. The first problem is the complexity and cost in adding a precharge circuit. This adds complexity to the design. The second problem is that of power waste. In the most efficient precharge scheme, each on pixel must be brought from its off voltage (which can be as low as 0 Volts) to its operating voltage to enable the light output and then returned to its off voltage to disable its light output. The charge which is sent into the parasitic capacitance to bring the pixel to operating voltage and that is then dumped when the pixel is turned off represents wasted power, since the charge does not flow through the pixel and therefore, does not contribute to light output. This wasted power is significant in displays of practical size and scan rate. In less efficient precharge schemes the problem is even worse since the entire display must be charged and discharged during each row scan, even when some pixels in the row being displayed are never turned on. Consequently, there is a need for an improved OLED display that addresses these issues.

SUMMARY OF THE INVENTION

One embodiment of the invention comprises a method of providing a voltage to at least one diode. The method comprises storing voltage data in a correction table, determining a voltage using at least in part the voltage data from the correction table, and applying the determined voltage to an organic light emitting diode.

Another embodiment of the invention comprises a method of providing a voltage to a diode. The method comprises determining a plurality of output voltage that are to be applied by a plurality of drivers to a plurality of columns of organic light emitting diodes in a video display and respectively applying the determined voltages to a plurality of columns the video display.

Yet another embodiment of the invention comprises a method of providing a voltage to at least one diode. The method comprises generating data for storage in the correction table. The correction table includes voltage data that is used to, among other things: (i) identify a voltage that is needed to provide a selected current to an average organic light emitting diode in the video display, (ii) identify at least one voltage characteristic of a particular light emitting diode, wherein the at least one voltage characteristic identifies a voltage amount that is needed to drive the particular light emitting diode as compared to an average organic light emitting diode, and (iii) account for resistance of the columns in the video display. The generated voltage data is stored in a correction table. A voltage is determined using at least in part the voltage data from the correction table. The method also comprises using two sample and hold capacitors per column driver, wherein the first capacitor has been charged to a first voltage to drive current across an organic light emitting diode in the first row of the video display and concurrently using a second capacitor to store a voltage to subsequently drive a current across an organic light emitting diode in a second row of the video display.

BRIEF DESCRIPTION OF THE DRAWINGS

The foregoing and other features and objects of the invention will become more fully apparent from the following description and appended claims taken in conjunction with the following drawings, in which like reference numbers indicate identical or functionally similar elements.

DETAILED DESCRIPTION OF EMBODIMENTS OF THE INVENTION

The embodiments described below overcome obstacles to the accurate generation of a desired amount of light output from an LED display, particularly in view of impediments which are rather pronounced in OLEDs, such as having a relatively high parasitic capacitance. However, the invention is more general than the embodiments that are explicitly described, and is not to be limited by the specific embodiments but rather is defined by the appended claims.

Figure 1B:
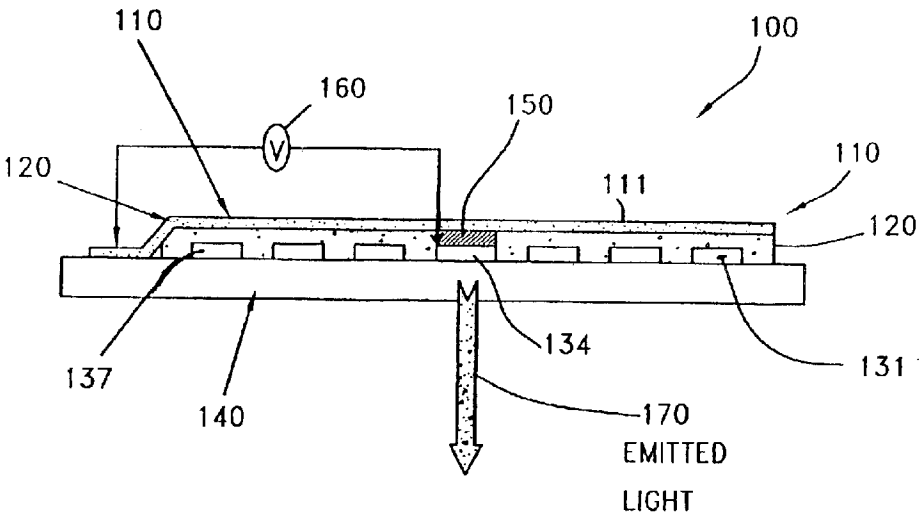
PRIOR ART FIG. 1B
FIG. 1B is a cross-sectional view of the OLED display of FIG. 1A.
Figure 1A:
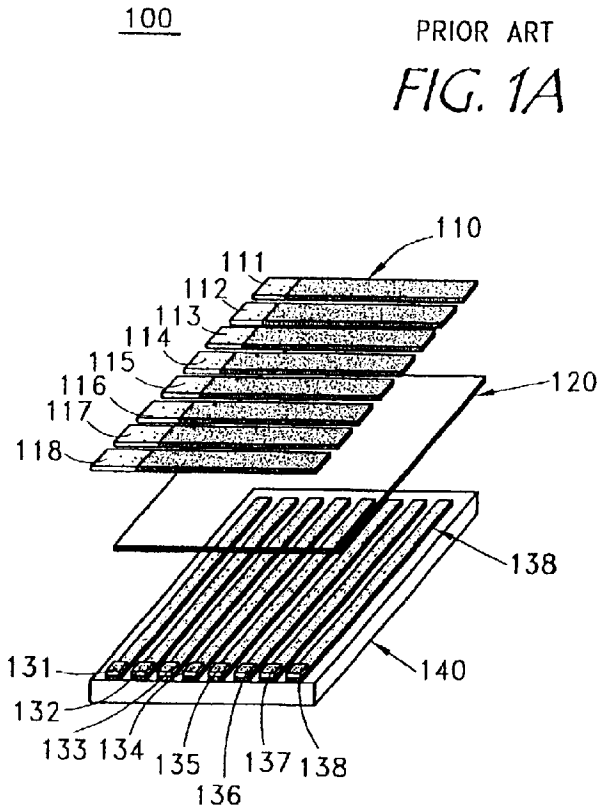
PRIOR ART FIG. 1A
FIG. 1A is a simplified exploded view of an OLED display.
Figure 2:
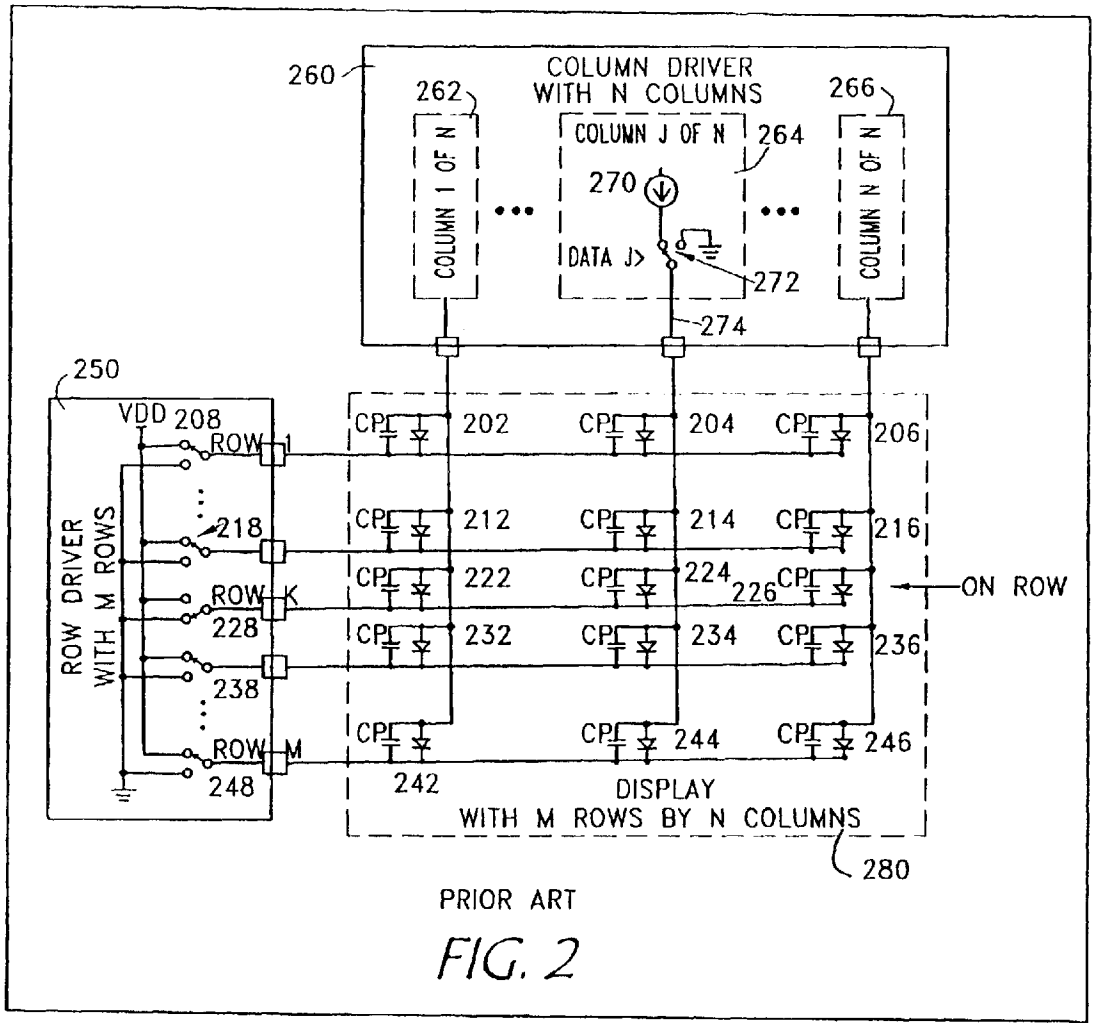
PRIOR ART FIG. 2
FIG. 2 is a schematic diagram of an OLED display with column and row drivers, where the OLED display may be configured as the display of FIGS. 1A and 1B.
Figure 3:
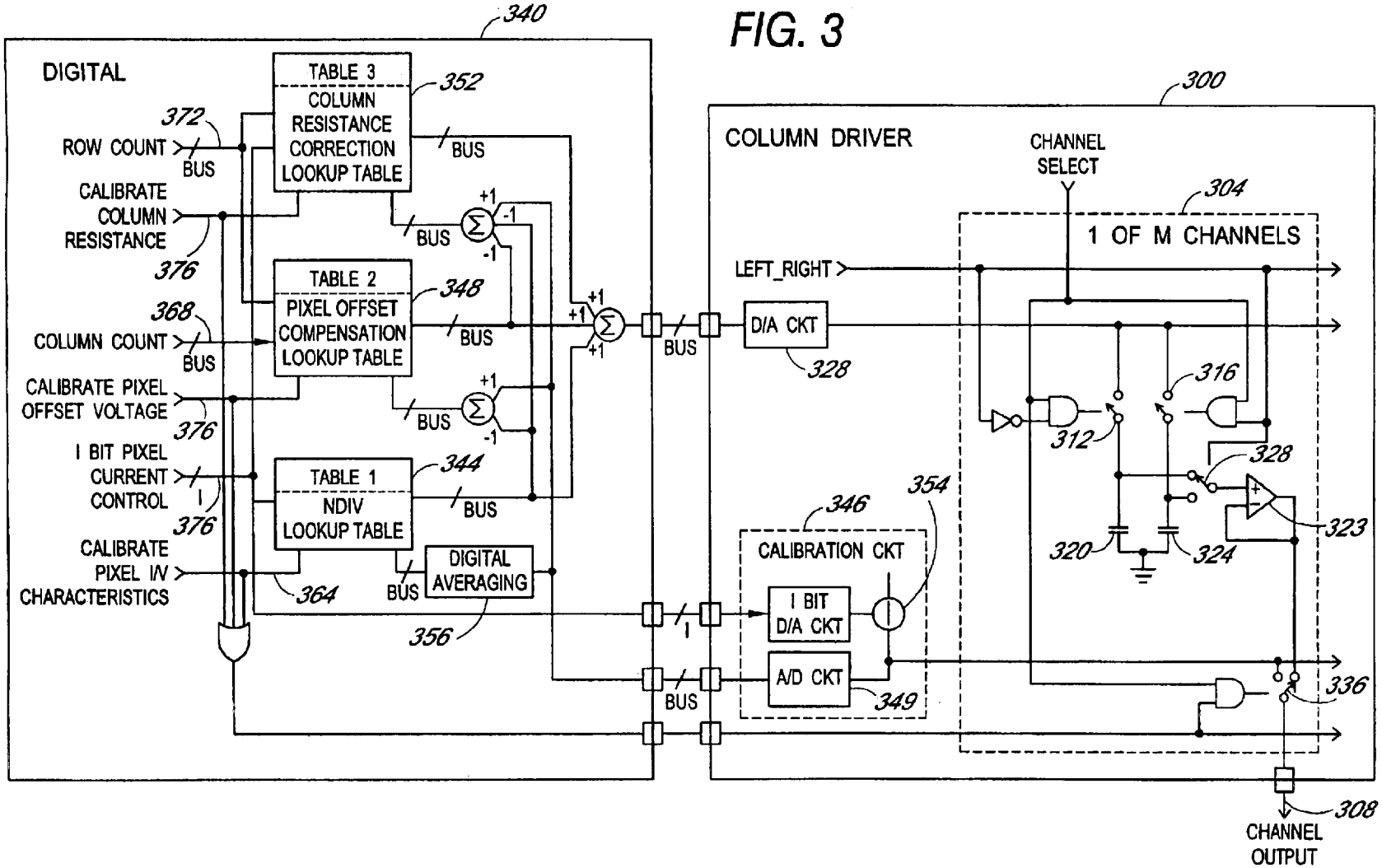
FIG. 3 is a block diagram illustrating one embodiment of a column driver of a video display.
Figure 4:
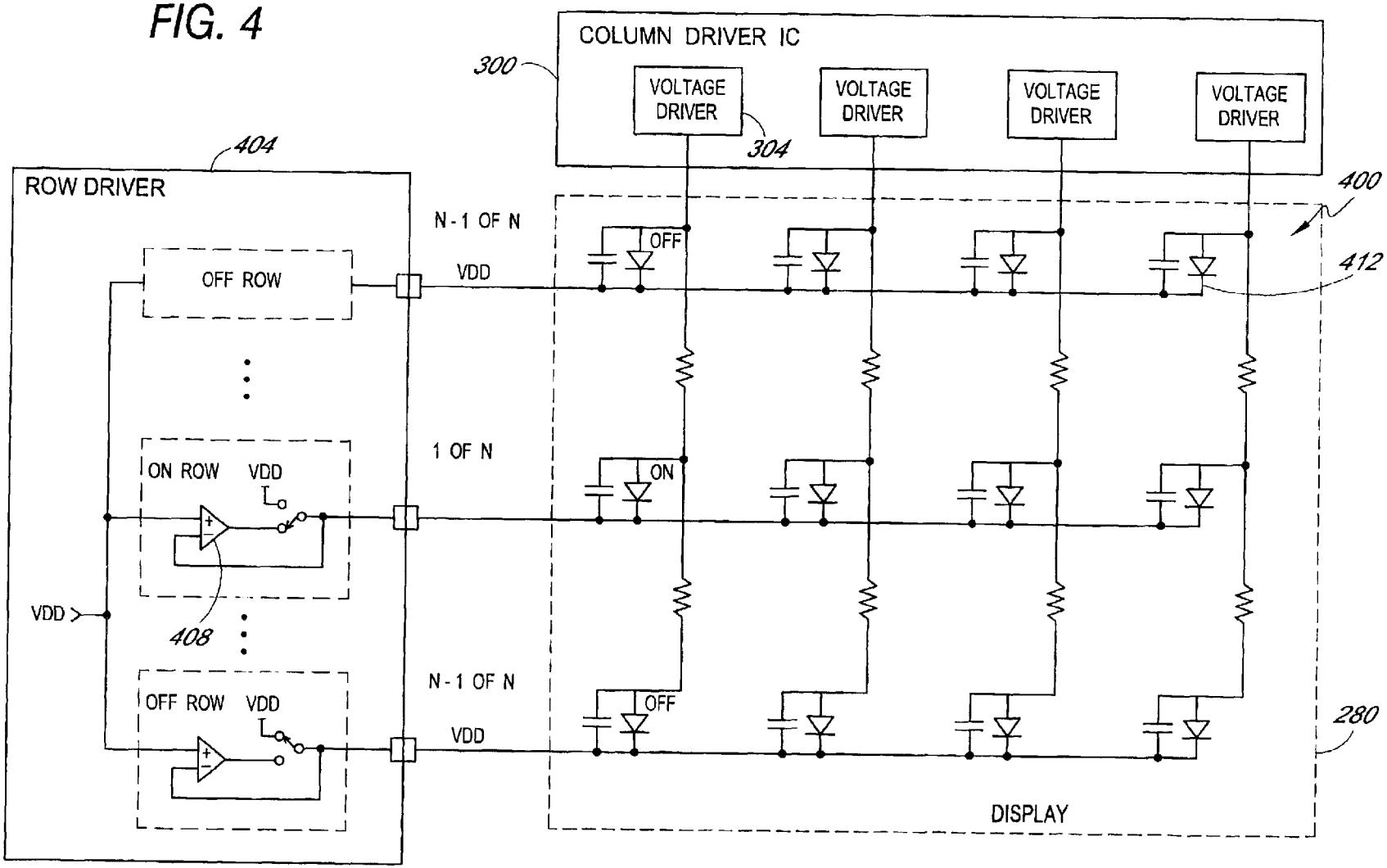
FIG. 4 is a block diagram illustrating one embodiment of a row driver for the video display of FIG. 3.

FIG. 3 is a block diagram illustrating one embodiment of a column driver 300 for a video display. The column driver includes a number of voltage drivers 304. In one embodiment of the invention, a voltage driver 304 is provided for each of the columns in a matrix 400 (FIG. 4). Each voltage driver 304 provides a voltage column output 308.

Each voltage driver 304 includes a first switch 312 and a second switch 316. The first switch 312 and the second switch 316 operate to respectively couple and decouple a first capacitor 320 and second capacitor 324 from a voltage source, such as digital to analog converter ("D/A CKT") 328. The column driver 300 samples that signal for the digital to analog converter 328 corresponding to that channel ("column") and then holds the signal. All columns drive the column inputs of the display (shown in FIG. 4). In one embodiment, all columns in the matrix 400 are updated each row scan time and output their data during a full row scan.

The column driver 300 closes the first switch 312 so as to charge the first capacitor 320 to an appropriate voltage to drive an element in a first row in the matrix 400 (FIG. 4). At substantially the same time, the second capacitor 324 can drive a current to another element in another row in the matrix. A third switch 328 switches operates to couple and decouple the first capacitor 320 and the second capacitor 324 to and from a particular column in the matrix 400. Optionally, the output from either the first capacitor 320 or the second capacitor 324 may be sent to a buffer 332. For efficiency reasons, one row of data is output in parallel while the next row is being serially loaded into the column driver 340. For a given row scan, one of the capacitors outputs column data while the other is updated. For the next row scan, the capacitors 320 and 324 swap functions.

A fourth switch 336 operates to couple the voltage driver 304 and a calibration circuit 346 from each of the columns in the matrix 400. During a calibration mode, the calibration circuit 346 is connected to the column in the matrix 400 via the switch 336. During normal operation, the voltage driver 304 is connected to the column in the matrix 400 via the switch 336.

The column driver 300 is connected to a digital circuit 340 that includes voltage correction tables. In one embodiment of the invention, the voltage correction tables includes a nominal diode desired current data byte, "i", to voltage conversion table ("NDIV lookup table") 344, a pixel offset compensation table 348, and a column resistance correction lookup table 352. The processes of generating the data in tables 344, 346, and 352 are described in further detail below with respect to FIGS. 7, 8, and 9.

The voltage correction tables are used to identify an appropriate voltage for driving a particular column in the matrix 400. The voltage correction tables can account for, among other things, column resistance, row resistance, diode mismatches, and uniform and/or differential diode aging. Depending on the embodiment, additional or fewer correction tables can be included in the digital circuit 340. Furthermore, in one embodiment of the invention, the digital circuit 340 is integrated with the column driver 300.

In one embodiment of the invention, the correction tables are calculated prior to and/or during normal circuit operation. Since the OLED output light level is linear with respect to OLED current, the correction scheme is based on sending a known current through the OLED diode for a duration sufficiently long to allow the transients to settle out and then measuring the corresponding voltage with an analog to digital converter (A/D) 349 residing on the column driver 300. A calibration current source 354 and the A/D 349 can be switched to any column through a switching matrix.

During operation, the NDIV lookup table 344 receives input from an "i" bit pixel current control bus 360. The "i" bit pixel current control bus 360 is used to specify one of $2^i$ current levels. Depending on the input current level, the NDIV lookup table can provide to the column driver 300 an appropriate voltage that is needed to drive the identified current level. During calibration, as is discussed further below, the NDIV lookup table 344 receives input from the digital averaging circuit 356. Calibration is initiated upon receipt of a signal via a calibrate pixel I/V characteristics line 364.

During operation, the pixel offset compensation lookup table 348 receives input from a column count bus 368 and a row count bus 372. The column count bus 368 and the row count bus 372 respectively identify a particular column and row in the matrix 400. In response to being provided a particular row and column, the pixel offset compensation table 348 can provide an offset voltage that accounts for aging or other element-specific characteristics of a particular diode in the matrix 400. During calibration, the pixel offset compensation lookup table 348 receives input from the NDIV lookup table 344 and from the calibration circuit 338. In one embodiment, calibration and generation of data in the pixel offset compensation lookup table 348 is initiated upon receipt of a signal via a calibrate pixel offset voltage line 362.

During operation, the column resistance correction lookup table 352 receives input from the row count bus 372. In one embodiment of the invention, the column resistance correction lookup table 352 includes the column resistance information for a single row. In this embodiment, it is assumed that an element in a selected row is substantially the same row resistance of another element in the same row that is another column. In another embodiment of the invention, the column resistance correction lookup table 352 includes column resistance information for each of the pixels in the matrix 400. In one embodiment, calibration and generation of data in the column resistance correction lookup table is initiated upon receipt of a signal via a calibrate column resistance line 376.

In one embodiment of the invention, the digital circuit 340 stores the voltage data in the correction tables using a 10 bit representation of the voltage. It is to be appreciated that other representations may be used. Furthermore, in this embodiment, the digital circuit 340 converts the input data from the "i" bit pixel current control from a lower resolution, e.g., 6 bits, to a higher resolution, e.g., 10 bits so as to provide greater control of the provided voltage.

The NDIV lookup table 344 stores the average OLED "on" voltage for each of the desired output levels. If the input data is 6 bits and the corrected output data is 10 bits this table would have $2^6$=64 entries of 10 bits each. This table is populated by driving several OLED elements in the display to each of the 64 possible current levels and averaging the results as read by the A/D 350 residing on the column driver 300. In one embodiment of the invention, the OLED elements selected for averaging are near the end of the display driven by the column driver 300, so that the effects of the column resistance are minimized.

Because of manufacturing variations and differential aging effects, each OLED element on the display can have a different offset voltage. The pixel offset compensation lookup table 348 stores these offsets. The pixel offset compensation lookup table 348 is populated by measuring each OLED display element at a low current. The measurement is made at low current levels to minimize the voltage drop due to parasitic display resistances. The expected average "on" voltage at that current, obtained from the NDIV table 344, is subtracted from the measurement and the result is stored in the pixel offset compensation lookup table 348. In one embodiment, for an N column by M row display, the NDIV table has N×M entries of 10 bits each.

The column resistance correction lookup table 352 stores the column resistances. In one embodiment, the resistances for each of the elements in one of the columns in the matrix 400 are stored, and it is assumed that all elements in other columns have similar resistances. The column resistance correction lookup table 352 is populated by measuring every OLED display element in one column at each of the 64 possible current levels. The expected average on voltage at that current, obtained from the NDIV table 344 and the offset voltage for that element, obtained from the pixel offset compensation lookup table 348 are subtracted from the measurement and the result is stored in the column resistance correction lookup table. For a 6 bit input word and a M row display this table has $M \times 2^6$ entries of 10 bits each.

In one embodiment, each 6 bit input data word is converted to a 10 bit corrected output word by summing the outputs of tables 344, 348, and 352. This 10 bit word is then sent to the column driver 300. The digital word is then converted to an analog voltage and is used to drive a column in the matrix 400. It is noted that FIG. 3 illustrates one possible implementation of the column driver 340. It is to be appreciated that other designs may be employed.

FIG. 4 is another block diagram of the video display including a row driver 404. In the embodiment of the invention shown in FIG. 4, the "on" row of the row driver 404 is driven by an operational amplifier 408 instead of a simple switch to ground. This lowers the output impedance of the "on" row and therefore reduces the voltage variation of the row. The matrix 400 comprises a plurality of elements 412, which each can include an organic light emitting diode.

Figure 5:
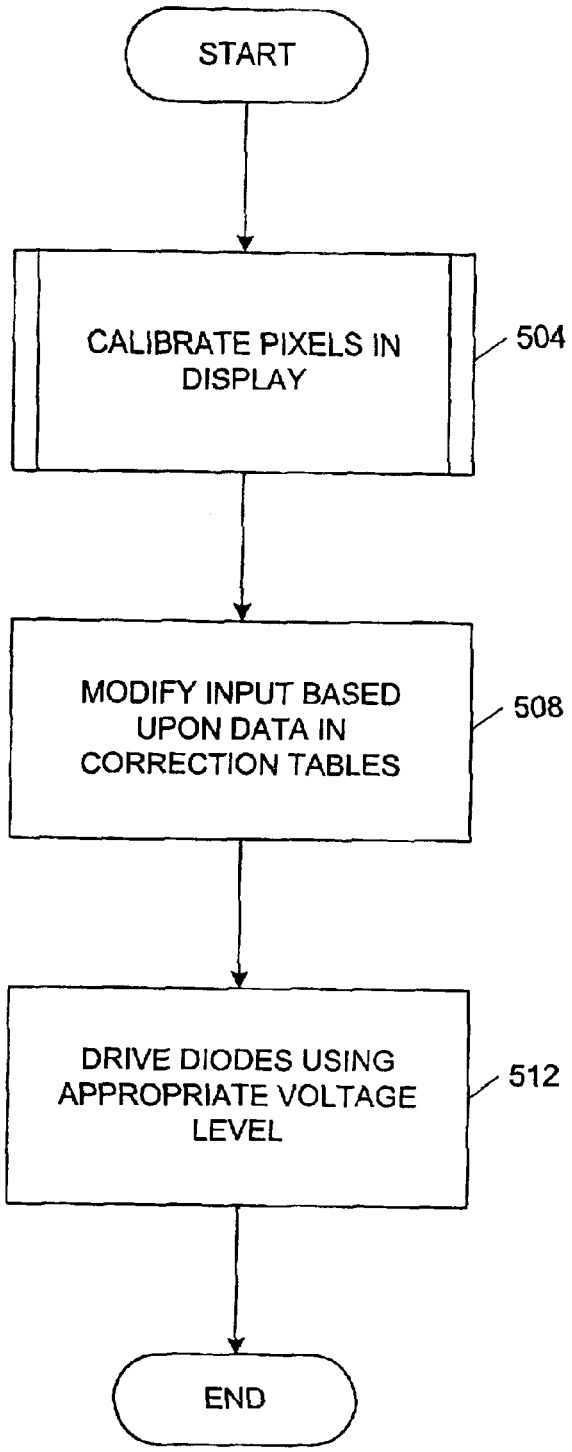
FIG. 5 is a flowchart illustrating a process of using the video display of FIGS. 3 and 4.

FIG. 5 is a flowchart illustrating an exemplary process of using the video display of FIGS. 4 and 5. Depending on the embodiment, additional steps can be added, others removed, and the ordering of the steps rearranged. Furthermore, selected steps can be merged into a single step.

Starting at a step 504, each of the pixels in the matrix are calibrated. The process of calibrating the pixels is described in greater detail below by reference to FIGS. 6–9.

Next, at a step 508, the video display receives video data from some external device or some device that is integrated with the video display. The data includes a column count that is provided by the column count bus 368, a row count that is provided by the row count bus 372, and an i bit pixel current control. Depending on the selected row, column, and requested current control level, the digital circuit 340 adds the respective voltage data from the column resistance correction lookup table 352, the pixel offset compensation lookup table 348, and the NDIV lookup table 344 and then provides the calculated voltage to the column driver 300.

Continuing to a step 512, the column driver 300 charges, depending which is not being currently used, one of either the first capacitor 320 or the second capacitor 324. The charged capacitor is connected to the column line in the matrix via the third switch 328 for the appropriate time so as to emit the desired amount of light in one of the elements in the matrix 400. In one embodiment, the column output 308 for a selected voltage driver 304 is held "on" for the entire row scan time and the output light intensity is controlled by varying the amplitude of the voltage that applied to the column.

Figure 6:
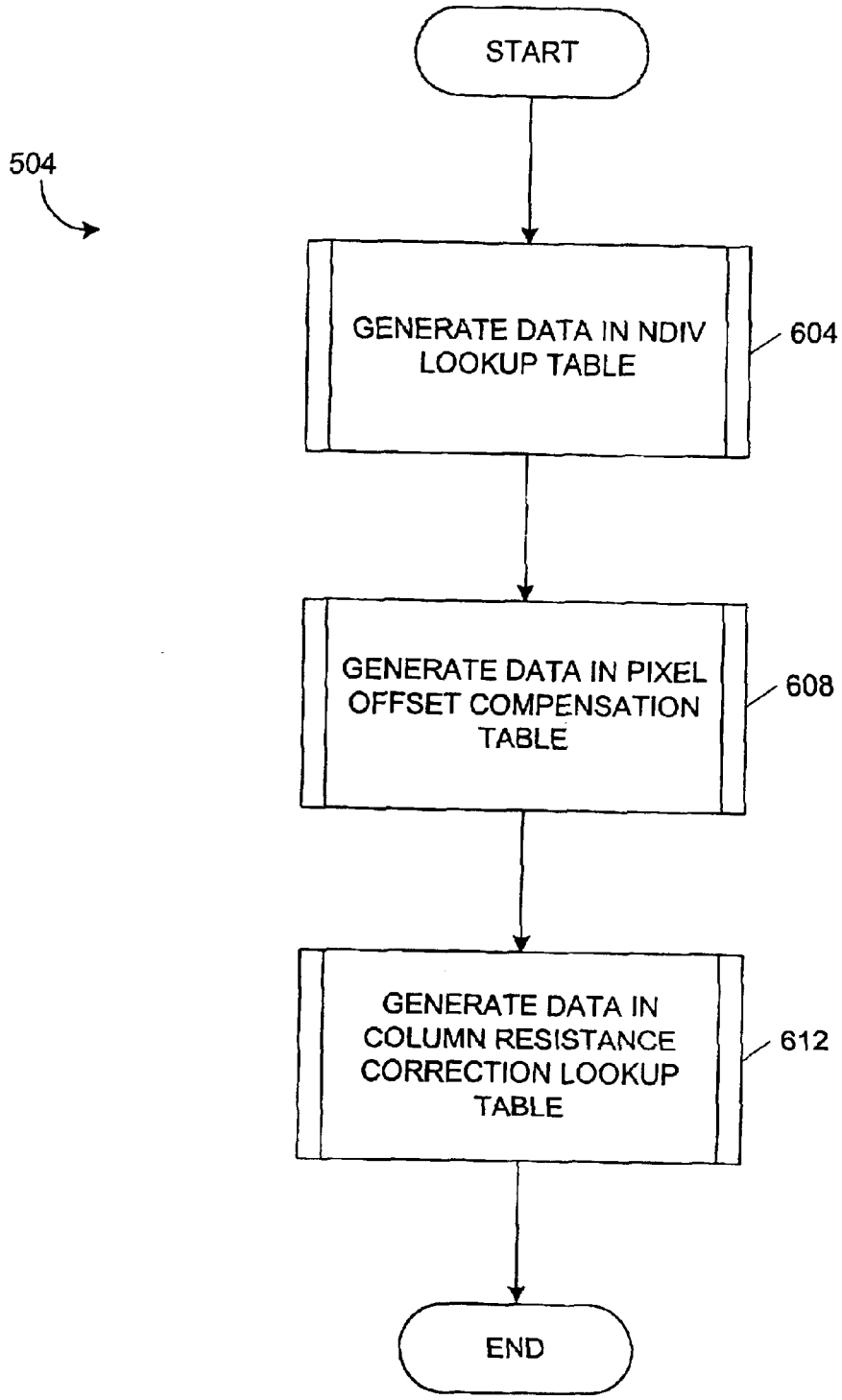
FIG. 6 is a flowchart illustrating one embodiment of a process of calibrating the pixels in the video display of FIGS. 3 and 4.

FIG. 6 is a flowchart illustrating one embodiment of a process of calibrating the video display of FIGS. 3 and 4. FIG. 6 illustrates in further detail the steps that occur in step 504 of FIG. 5. Depending on the embodiment, additional steps can be added, others removed, and the ordering of the steps rearranged. Furthermore, selected steps can be merged into a single step.

Starting at a step 604, the digital circuit 340 generates the data in the NDIV lookup table 344. One exemplary process of generating data in the NDIV lookup table 344 is described below with respect to FIG. 7. In one embodiment of the invention, the data for the NDIV lookup table 344 is generated in response to receiving a signal from the calibrate pixel I/V characteristics line 364.

Next, at a step 608, the digital circuit 340 generates the data in the pixel offset compensation table 348. One exemplary process of generating data in the pixel offset compensation table 348 is described below with respect to FIG. 8. In one embodiment of the invention, the data for the pixel offset compensation table 348 is generated in response to receiving a signal from the pixel offset voltage line 376.

Continuing to a step 612, the digital circuit 340 generates the data in the column resistance correction lookup table 352. One exemplary process of generating data in the column resistance lookup table is described below with respect to FIG. 9. In one embodiment of the invention, the data for the column resistance lookup table 352 is generated in response to receiving a signal from the calibrate column resistance line 376.

Figure 7:
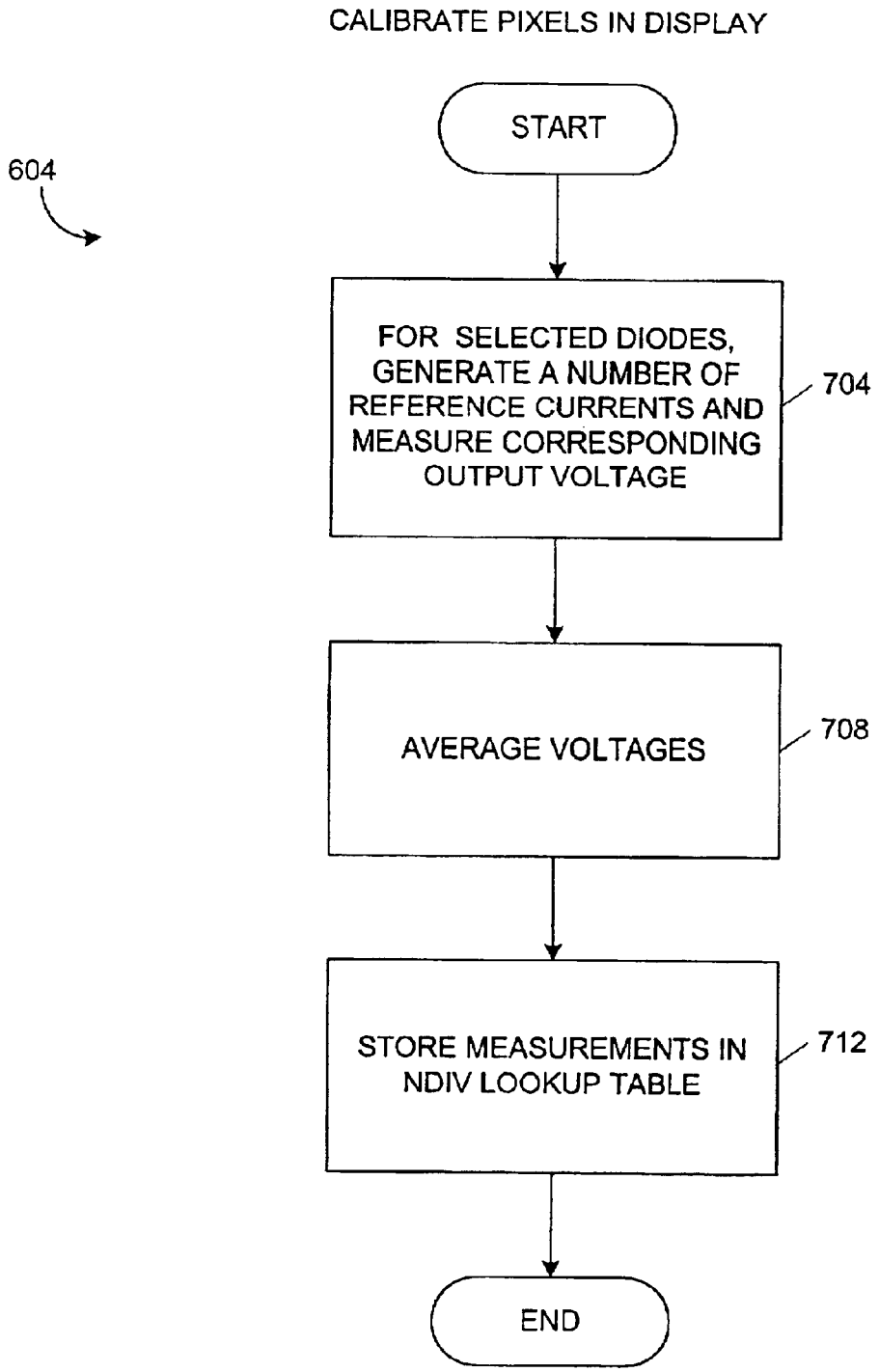
FIG. 7 is a flowchart illustrating one embodiment of a process of generating a first correction table for the video display of FIGS. 3 and 4.

FIG. 7 is a flowchart illustrating one embodiment of a process of generating the data in the NDIV lookup table 344. FIG. 7 illustrates in further detail the steps that occur in step 604 of FIG. 6. Depending on the embodiment, additional steps can be added, others removed, and the ordering of the steps rearranged. Furthermore, selected steps can be merged into a single step.

Starting at a step 704, one or more of the diodes in the matrix are selected. For each of the selected diodes, the calibration circuit 338 generates a number of reference currents and measures the corresponding voltage. In one embodiment of the invention, each of the diodes in the matrix 400 are selected. In another embodiment of the invention, one diode from each of the columns are selected. In another embodiment of the invention, each of the diodes in a selected column are selected. The calibration circuit 338 measures the corresponding voltage that is generated in response to provided reference currents.

Continuing to a step 708, the digital averaging circuit 356 receives the measured voltages and averages the voltage data for each the respective reference currents. Next, at a step 712, the averaged data for each of the reference currents is stored in the NDIV lookup table 344.

Figure 8:
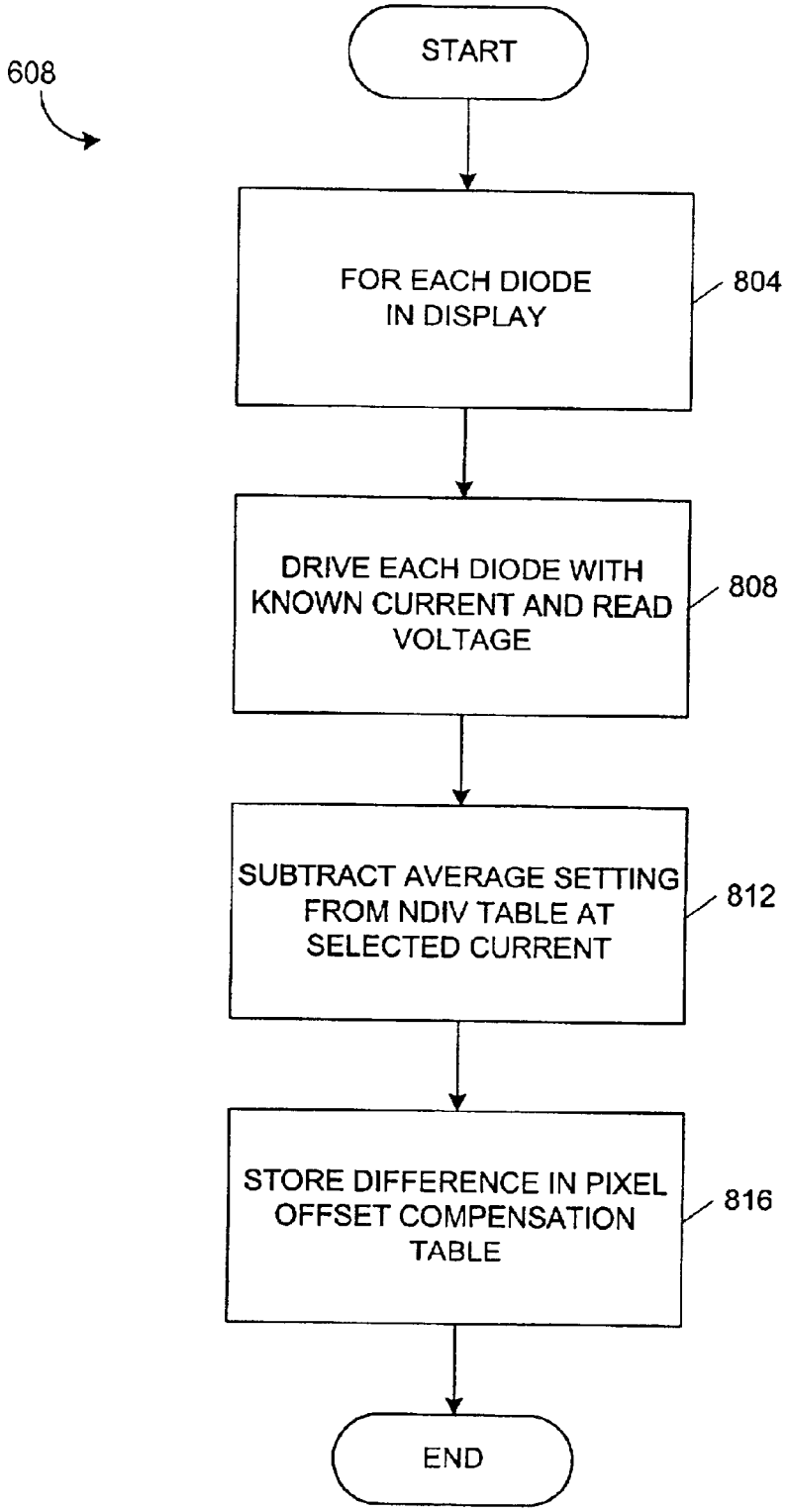
FIG. 8 is a flowchart illustrating one embodiment of a process of generating a second correction table for the video display of FIGS. 3 and 4.

FIG. 8 is a flowchart illustrating a process of generating the data in the pixel offset compensation lookup table 348. FIG. 8 illustrates in further detail the steps that occur in step 608 of FIG. 6. Depending on the embodiment, additional steps can be added, others removed, and the ordering of the steps rearranged. Furthermore, selected steps can be merged into a single step.

It is noted in one embodiment of the invention that steps 808, 812, and 816 are performed for each of the diodes in the matrix 400. Starting at a step 804, a selected diode in the matrix 400 is selected. Next, at a step 808, the calibration circuit 336 drives the selected current with a known current. In one embodiment of the invention, the known currently is relatively low as compared to normal operating levels so as to obtain minimal voltage drop due to resistive effects of the column and row in the matrix 400.

Next, at step 812, corresponding voltage for the selected current from the NDIV lookup table 344 is retrieved. The digital circuit 340 subtracts the result identified voltage from step 808 from the average voltage. Continuing to a step 816, the digital circuit 340 stores the difference in the pixel offset compensation lookup table 348.

Figure 9:
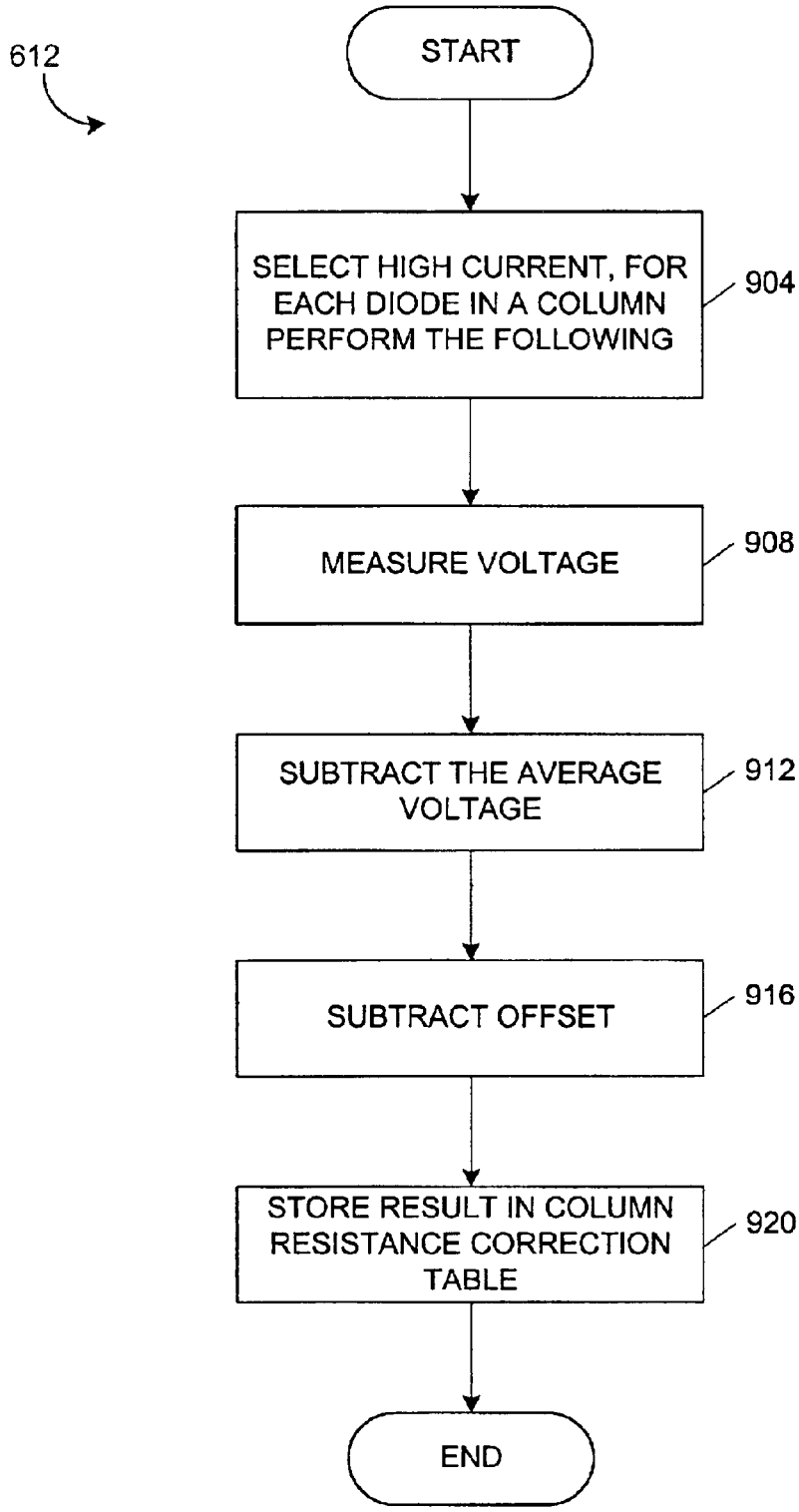
FIG. 9 is a flowchart illustrating one embodiment of a process of generating a first correction table for the video display of FIGS. 3 and 4.

FIG. 9 is a flowchart illustrating a process of generating the data in the column resistance correction lookup table 348. FIG. 9 illustrates in further detail the steps that occur in step 612 of FIG. 6. Depending on the embodiment, additional steps can be added, others removed, and the ordering of the steps rearranged. Furthermore, selected steps can be merged into a single step.

Starting at a step 904, the calibration circuit 338 selects a high current with respect to normal operating values. Then, for each diode in a selected column, the digital circuit 340 performs steps 908–920. At the step 908, the digital circuit 340 measures the voltage for the currently selected diode. Next, at the step 912, the digital circuit subtracts from the measured voltage (step 908) the average voltage for current that is stored in the NDIV lookup table 344. Continuing to a step 916, the digital circuit 340 stores the result in the column resistance correction table 352.

From the foregoing description, it is seen that the NDIV lookup table 344 provides a transfer function between the data signal input and light output. Light output is approximately linear with respect to the current applied. The current flowing through the OLED diode is to a first order independent of the display column and row parasitic resistances. In the video display of FIGS. 3 and 4, each of the elements are driven with a voltage rather than a current, and that voltage varies from pixel to pixel as a function of desired pixel brightness. The video display of FIGS. 3 and 4 account for the fact that the relationship between drive voltage applied to an OLED pixel and the light generated from that pixel is highly non-linear and varies substantially with temperature, process, and display aging. The video display of FIGS. 3 and 4 compensate for these affects and make a pulse amplitude modulation system practical to use and build.

Advantageously, the column driver of FIG. 3 can replace conventional systems that control pixel light intensity by pulse width modulating (PWM) the signal. In known systems, the column voltage transitions from the pixel-on voltage, to the pixel-off voltage, and back to the pixel-on voltage in going from any given row to the next row. Using the voltage driver 304, the column voltage can transition from the on-voltage of the presently driven pixel directly to the on-voltage of the pixel in the next row that is to be driven. This significantly reduces the power wasted in charging and discharging the parasitic capacitance of the display. How much power is saved is a function of the image that is displayed. The closer the light output matches between adjacent pixels in a column, the closer the on-voltages match, and the more power that is saved when contrasted with pulse width modulating devices.

While the above description has pointed out novel features of the invention as applied to various embodiments, the skilled person will understand that various omissions, substitutions, and changes in the form and details of the device or process illustrated may be made without departing from the scope of the invention. For example, those skilled in the art will understand that the orientation, polarity, and connections of devices in the display matrix are matters of design convenience. The skilled person will be able to adapt the details described herein to a system having different devices, different polarities, or different row and column architectures. Such alternative systems are implicitly described by extension from the description above, and are contemplated as alternative embodiments of the invention. Therefore, the scope of the invention is defined by the appended claims rather than by the foregoing description. All variations coming within the meaning and range of equivalency of the claims are embraced within their scope.

What is claimed is:

1. A method of applying a voltage, the method comprising:

storing voltage data in a column resistance correction table, the voltage data being derived based, at least in part, on a plurality of reference currents;

determining a voltage using, at least in part, the voltage data from the correction table;

applying the determined voltage to an organic light emitting diode; and charging a first capacitor to a first voltage to drive a current across an organic light emitting diode in a first row of a video display, and using a second capacitor to drive a current across an organic light emitting diode in a second row of the video display.

2. The method of claim 1, additionally comprising generating the voltage data for storage in the correction table.

3. The method of claim 2, wherein generating the voltage data comprises providing the plurality of reference currents across at least the diode and measuring the corresponding output voltage.

4. The method of claim 2, additionally comprising:

identifying a voltage level that is needed to provide a selected current;

identifying the at least one voltage characteristic of a particular light emitting diode; and compensating for a resistance based as least in par upon a resistance of at least one of the columns in the video display.

5. The method of claim 2, additionally comprising:

identifying a voltage level that is needed to provide a selected current;

identifying at least one voltage characteristic of a particular light emitting diode;

compensating a voltage based at least in part upon a resistance of at least one of the columns in the video display; or compensating a voltage based at least in part upon a resistance of at least one of the rows in the video display.

6. A method, comprising:

determining a plurality of output voltages for driving a plurality of columns of organic light emitting diodes in a video display, the plurality of output voltages being derived based, at least in part, on a plurality of reference current and column resistance correction data;

respectively applying the determined voltages to a plurality of columns of the video displaying; and charging a first capacitor to a first voltage to chive a current across an organic light emitting diode in a first row of a video display, and using a second capacitor to drive a current across an organic light emitting diode in a second row of the video display.

7. The method of claim 6, wherein each of the organic light emitting diodes in the video display is part of a passive matrix of light emitting diodes.

8. A method, comprising:

generating data for storage in a correction table, wherein the correction table includes voltage data that is used to: (i) identify a voltage that is needed to provide a selected current to an organic light emitting diode in the video display, (ii) identify at least one voltage characteristic of a particular light emitting diode, wherein the at least one voltage characteristic identifies a voltage amount that is needed to drive the particular light emitting diode as compared to an average organic light emitting diode, and (iii) compensate for resistance of at least one of the columns in the video display;

storing the generated voltage data in a correction table;

determining a voltage using, at least in part, the voltage data from the correction table;

charging a first capacitor to a first voltage so as to drive current across an organic light emitting diode in a first row of the video display; and with said act of charging using a second capacitor to drive a current across an organic light emitting diode in a second row of the video display.

* * * * *

UNITED STATES PATENT AND TRADEMARK OFFICE

CERTIFICATE OF CORRECTION

PATENT NO. : 6,963,321 B2
APPLICATION NO. : 10/029563
DATED : December 20, 2001
INVENTOR(S) : James W. Everitt It is certified that error appears in the above-identified patent and that said Letters Patent is hereby corrected as shown below:

In column 1, lines 9-10, delete “DEVICES”and” and insert -- DEVICES” and --, therefor.

In column 3, line 5, delete “element” and insert -- elements --, therefor.

In column 10, line 45, in Claim 4, delete “par” and insert -- part --, therefor.

In column 10, line 65, in Claim 6, delete “current” and insert -- currents --, therefor.

In column 10, line 67, in Claim 6, delete “displaying;” and insert -- display; --, therefor.

In column 11, line 1, in Claim 6, delete “chive” and insert -- drive --, therefor.

Signed and Sealed this

Twenty-fourth Day of April, 2007

JON W. DUDAS
*Director of the United States Patent and Trademark Office*

UNITED STATES PATENT AND TRADEMARK OFFICE

CERTIFICATE OF CORRECTION

PATENT NO. : 6,963,321 B2
APPLICATION NO. : 10/029563
DATED : November 8, 2005
INVENTOR(S) : James W. Everitt It is certified that error appears in the above-identified patent and that said Letters Patent is hereby corrected as shown below:

In column 1, lines 9-10, delete "DEVICES"and" and insert -- DEVICES" and --, therefor.

In column 3, line 5, delete "element" and insert -- elements --, therefor.

In column 10, line 45, in Claim 4, delete "par" and insert -- part --, therefor.

In column 10, line 65, in Claim 6, delete "current" and insert -- currents --, therefor.

In column 10, line 67, in Claim 6, delete "displaying;" and insert -- display; --, therefor.

In column 11, line 1, in Claim 6, delete "chive" and insert -- drive --, therefor.

This certificate supersedes Certificate of Correction issued April 24, 2007.

Signed and Sealed this

Twenty-second Day of May, 2007

JON W. DUDAS
*Director of the United States Patent and Trademark Office*